US008322356B2

(12) United States Patent
Carter

(10) Patent No.: US 8,322,356 B2
(45) **Date of Patent: *Dec. 4, 2012**

(54) CRAFT DOME

(76) Inventor: Mark C. Carter, Murieta, CA (US)

( * ) Notice: Subject to any disclaimer, the term of this patent is extended or adjusted under 35 U.S.C. 154(b) by 5 days.

This patent is subject to a terminal disclaimer.

(21) Appl. No.: 13/289,405

(22) Filed: Nov. 4, 2011

(65) Prior Publication Data

US 2012/0055524 A1 Mar. 8, 2012

Related U.S. Application Data

(63) Continuation of application No. 12/938,266, filed on Nov. 2, 2010, now Pat. No. 8,061,378, which is a continuation of application No. 12/610,159, filed on Oct. 30, 2009, now Pat. No. 7,836,907, which is a continuation of application No. 11/947,236, filed on Nov. 29, 2007, now Pat. No. 7,628,166.

(60) Provisional application No. 60/872,365, filed on Nov. 30, 2006.

(51) Int. Cl.
*E04H 15/50* (2006.01)
*E04H 15/38* (2006.01)

(52) U.S. Cl. ..... 135/131; 135/136; 135/145; 135/135

(58) Field of Classification Search ..... 135/121, 135/122, 29, 130, 138, 143, 144, 147, 157, 135/158, 160, 906, 124, 128, 136, 145
See application file for complete search history.

(56) References Cited

U.S. PATENT DOCUMENTS

| | | | | |
|---|---|---|---|---|
| 4,779,635 | A | 10/1988 | Lynch | |
| 5,638,853 | A | 6/1997 | Tsai | |
| 6,070,604 | A | 6/2000 | Carter | |
| 6,138,702 | A | 10/2000 | Carter | |
| 6,868,858 | B2 | 3/2005 | Suh | |
| 7,428,908 | B2 | 9/2008 | Seo | |
| 7,628,166 | B2 | 12/2009 | Carter | |
| 7,836,907 | B2 | 11/2010 | Carter | |
| 8,061,378 | B2 * | 11/2011 | Carter | 135/131 |

* cited by examiner

*Primary Examiner* — David Dunn
*Assistant Examiner* — Danielle Jackson
(74) *Attorney, Agent, or Firm* — Fulwider Patton LLP

(57) ABSTRACT

The quickly erectable dome shelter includes an extendible perimeter truss assembly with link members connected between adjacent legs, a central truss assembly of link members, and a roof framework, including pairs of curved upper and lower peak truss members, that is movable between a lowered, collapsed configuration and a raised, upwardly arching position. The shelter also includes telescoping peak pole members coupled to the central truss assembly of link members and the roof framework, and may also include telescoping peak truss brace members connected between a peak truss member and a link member of the perimeter assembly of link members.

9 Claims, 14 Drawing Sheets

CRAFT DOME

CROSS-REFERENCES TO RELATED APPLICATIONS

This application is a continuation of application Ser. No. 12/938,266, filed Nov. 2, 2010, now U.S. Pat. No. 8,061,378, which is a continuation of application Ser. No. 12/610,159, filed Oct. 30, 2009, now U.S. Pat. No. 7,836,907, which is a continuation of application Ser. No. 11/947,236, filed Nov. 29, 2007, now U.S. Pat. No. 7,628,166, which is based upon Provisional Application No. 60/872,365, filed 30 Nov. 2006, the entire contents of which are incorporated herein by reference.

BACKGROUND OF THE INVENTION

This invention relates generally to folding, collapsible structures, and more particularly relates to a quickly erectable dome shelter including a roof structure formed by a plurality of articulated assemblies of curved peak truss members.

Temporary shelters that can be easily transported and rapidly set up at emergency sites can be particularly useful in providing temporary care and housing. Such shelters can also be useful for non-emergency outdoor gatherings, such as for temporary military posts, field trips, and the like. One known quickly erectable, collapsible shelter includes a framework of X-shaped linkages, telescoping legs, and a canopy covering the framework. The legs of that shelter are capable of telescoping to about twice their stowed length, and the framework of X-shaped truss pairs is capable of horizontal extension between the legs to support a canopy. The framework can be constructed of lightweight material, and the telescoping legs can be extended to raise the framework of the shelter.

SUMMARY OF THE INVENTION

Briefly, and in general terms, the present invention provides for a quickly erectable dome shelter having opposing front and rear sides and opposing lateral sides, and including an extendible perimeter truss assembly including a plurality of legs and a plurality of link members connected between adjacent legs, each of the legs having an upper end and a lower end, and a roof framework pivotally mounted to the extendible perimeter assembly so as to extend across the shelter in an extended raised, upwardly arching configuration.

In a presently preferred aspect, the roof framework that is movable between a lowered, collapsed configuration and the raised, upwardly arching position, and includes a plurality of articulated peak truss assemblies including first and second pairs of curved upper peak truss members and curved lower peak truss members, with the curved upper peak truss members and curved lower peak truss members being pivotally connected together at a peak truss pivot point. In another presently preferred aspect, each of the first and second pairs of curved upper peak truss members and lower peak truss members are spaced apart by a spacer member at the peak truss pivot point. Each of the lower peak truss members typically include an upper curved portion and a straight bottom end portion extending at an oblique angle from the upper curved portion, and in another presently preferred aspect, the plurality of articulated peak truss assemblies includes front side and rear side pairs of first and second pairs of curved upper peak truss members and curved lower peak truss members, and the bottom end portions of the front and rear side lower peak truss members are pivotally connected by a peak mount bracket to the perimeter assembly of link members and the upper portion of a corresponding adjacent leg. In another aspect, the articulated peak truss assemblies may include a center pair of first and second pairs of curved upper peak truss members and curved lower peak truss members, with the bottom end portions of the center lower peak truss members pivotally connected by a center peak mount bracket to the perimeter assembly of link members. The quickly erectable dome shelter may also include a central truss assembly of link members, and the bottom end portions of the center lower peak truss members may also be pivotally connected by the center peak mount bracket to the central truss assembly of link members.

In another aspect, the central truss assembly of link members is connected between the front and rear sides of the perimeter assembly, and is connected between opposing lateral sides of the perimeter assembly to stabilize and support the quickly erectable dome shelter. The central truss assembly of link members includes a plurality of central truss pairs of link members, with each of the central truss pairs being pivotally connected to the inner ends of the perimeter truss pairs at the outer truss pivot point. In another presently preferred aspect, each of the central truss pairs is pivotally connected to the inner ends of the perimeter truss pairs at the outer truss pivot point by right angle bracket members, to which the inner ends of the second perimeter truss pairs and the outer central truss pairs are pivotally connected. In another aspect, each of the central truss pairs includes a first link and a second link, with the first link having an outer end connected to the inner end of the second link of the perimeter truss pair, an inner end, and a central truss pivot point located approximately at the longitudinal center point of the central truss pair first link, the second link having an outer end connected to the inner end of the first link of the perimeter truss pair, an inner end, and a central truss pivot point located approximately at the longitudinal center point of the central truss pair second link. The first and second links of the central truss pairs are pivotally connected together to extend horizontally between the sides of the shelter framework.

In another aspect, the quickly erectable dome shelter may include a plurality of telescoping peak pole members pivotally and slidably coupled to the central truss assembly of link members and pivotally connected to the plurality of articulated peak truss assemblies at the upper ends of the telescoping peak pole members. The inner ends of the central truss pairs may be connected to at least one vertically oriented central telescoping peak pole member provided to support the canopy when the shelter framework is in an extended configuration. In another presently preferred aspect, the central telescoping peak pole member comprises a hollow lower peak pole slider tube and an upper peak pole shaft slidably disposed within the hollow lower peak pole slider tube, the upper peak pole shaft including an upper end with a central peak pole tip member affixed at the top end of the upper peak pole shaft.

The quickly erectable dome shelter may also include a central peak pole slider member pivotally connected to the upper inner ends of the central truss pairs, with the lower inner ends of each of the first links of the central truss pairs of link members pivotally connected to the lower end of the central peak pole member, and the upper inner ends of each of the second links of the central truss pairs pivotally connected to the central slider member.

In another aspect, the plurality of telescoping peak pole members may include front side and rear side vertically oriented side telescoping peak pole members, provided to support the canopy when the shelter framework is in an extended configuration. The front side and rear side vertically oriented side telescoping peak pole members each typically include a hollow lower peak pole slider tube and an upper peak pole shaft having a lower portion slidably disposed within the hollow lower peak pole slider tube and including an upper end, the upper peak pole shaft including an upper end with a side peak pole tip member affixed at the top end of the upper peak pole shaft. Each of the front side and rear side vertically oriented side telescoping peak pole members also typically include a side peak pole slider member pivotally connected to the upper inner ends of the front and rear side perimeter truss pairs, with the lower inner ends of each of the first links of the front and rear side perimeter truss pairs pivotally connected to the lower end of the side peak pole member, and the upper inner ends of each of the second links of the front and rear side perimeter truss pairs pivotally connected to the side peak pole slider member.

In another aspect, each of the plurality of legs of the extendible perimeter truss assembly is typically hollow and may include a telescoping foot section slidably disposed within the hollow leg for engagement with a substrate. In another presently preferred aspect, each of the plurality of legs comprises a slider member slidably mounted thereto.

The pairs of individual link members may include a first link member and a second link member, with the first link member having an outer end pivotally connected to the upper end of a leg, and the second link member having an outer end pivotally connected to one the slider member. In another presently preferred aspect, the plurality of link members of the extendible perimeter truss assembly form X-shaped outer trusses formed of pairs of individual link members pivotally connected together, with the pairs of individual link members pivotally connected together at an outer truss pivot point, and the pairs of individual link members may be spaced apart by a spacer member at the outer truss pivot point. In another presently preferred aspect, the first and second link members are connected together in a scissors configuration so as to be extendable from a first collapsed position extending horizontally between pairs of legs to a second extended position extending horizontally between the pairs of legs.

In another aspect, the quickly erectable dome shelter may include one or more telescoping peak truss brace members pivotally connected between a front side or rear side peak truss member and a link member of the perimeter assembly of link members. Each the telescoping peak truss brace member typically includes a hollow lower peak truss brace slider tube pivotally connected to a link member of the perimeter assembly of link members by a peak truss rod slider spacer member, and an upper peak truss brace shaft having a lower portion slidably disposed within the hollow lower peak truss brace slider tube and including an upper end with a yoke pivotally connected to a lower peak truss member. The quickly erectable dome shelter may also include one or more telescoping peak truss brace members pivotally connected between a central peak truss member and a link member of the central truss assembly of link members, and each of the telescoping peak truss brace members typically includes a hollow lower peak truss brace slider tube pivotally connected to a link member of the central truss assembly of link members by a peak truss rod slider spacer member, and an upper peak truss brace shaft having a lower portion slidably disposed within the hollow lower peak truss brace slider tube and including an upper end with a yoke pivotally connected to a lower peak truss member.

Other features and advantages of the present invention will become more apparent from the following detailed description of the preferred embodiments in conjunction with the accompanying drawings, which illustrate, by way of example, the operation of the invention.

DETAILED DESCRIPTION OF THE PREFERRED EMBODIMENTS

Figure 1:
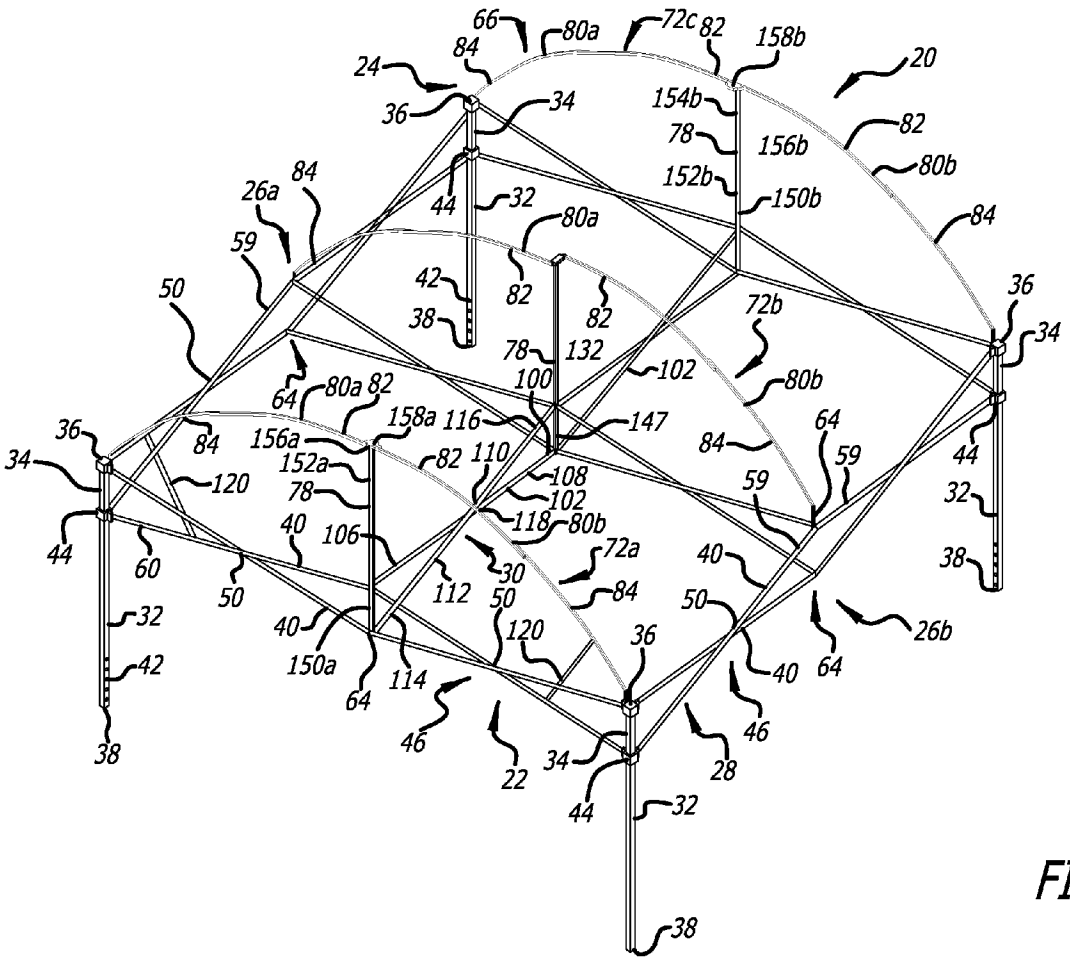
FIG. 1 is a perspective view of the quickly erectable dome shelter of the present invention in a raised, upwardly arching configuration.

Referring to the drawings, the present invention provides for a quickly erectable dome shelter 20 having a front side 22, a rear side 24, and opposing lateral sides 26*a*, 26*b*, as is illustrated in FIG. 1. The quickly erectable dome shelter includes an extendible perimeter truss assembly 28 and a central truss assembly 30 of link members connected between the front and rear sides of the perimeter assembly, and connected between opposing lateral sides of the perimeter assembly to stabilize and support the quickly erectable dome shelter to stabilize and support the quickly erectable dome shelter.

Figure 2:
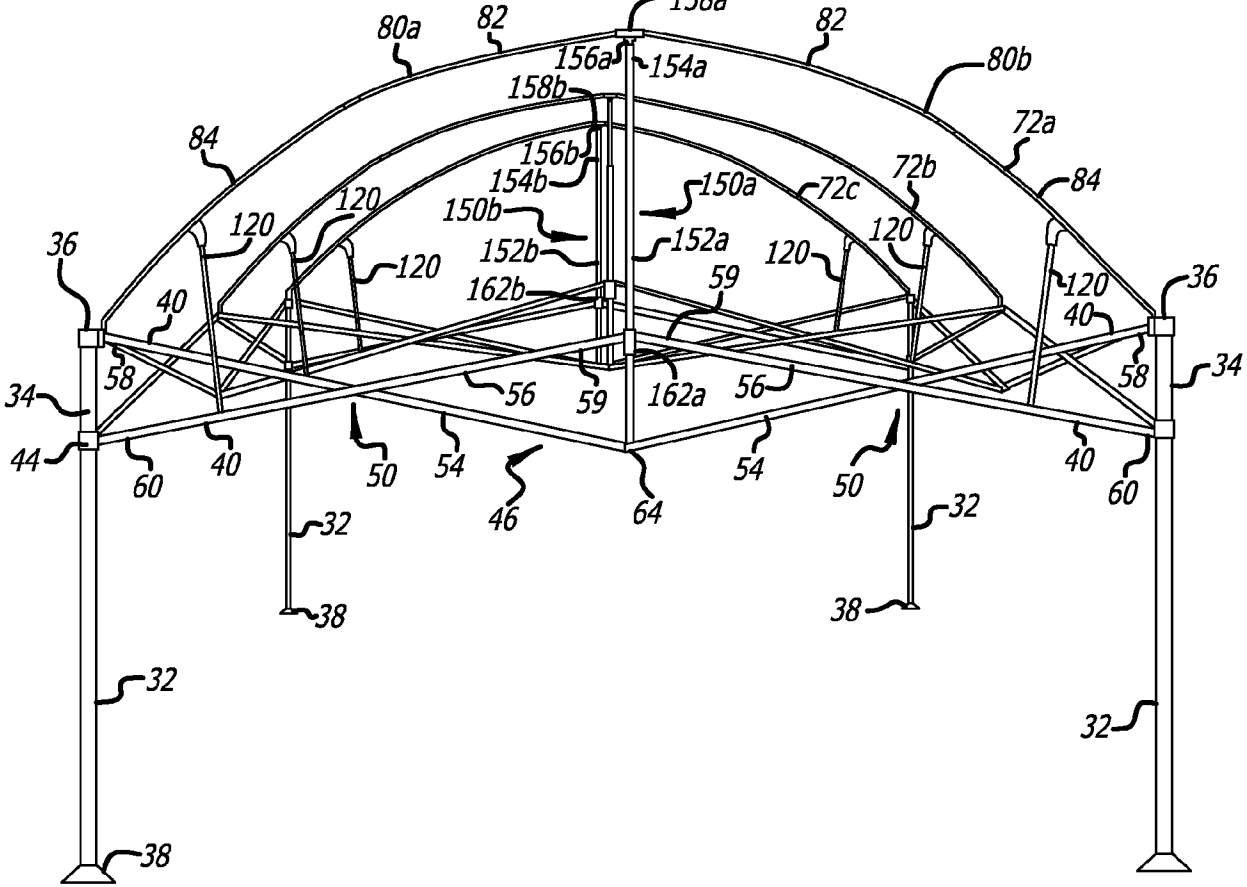
FIG. 2 is a front view of the quickly erectable dome shelter of FIG. 1.

Referring to FIGS. 1 and 2, the extendible perimeter truss assembly includes a plurality of legs 32, such as four hollow legs, for example, each having an upper end 34 that can be protected with an upper cap 36, and a lower end 38. The extendible perimeter truss assembly also includes a plurality of individual link members 40 connected between adjacent legs. Each of the lower ends of the legs may also include a telescoping foot section (not shown) slidably disposed within the hollow leg for engagement with the ground, a platform, floor or the like. The upper portion of the telescoping foot section may include a spring loaded detent pin (not shown) that snaps into position in a corresponding hole 42 in the leg when the telescoping foot section is extended, to automatically lock the foot section in position. A slider member 44 is typically slidably mounted to each leg, such as at an upper section of the leg.

Figure 9:
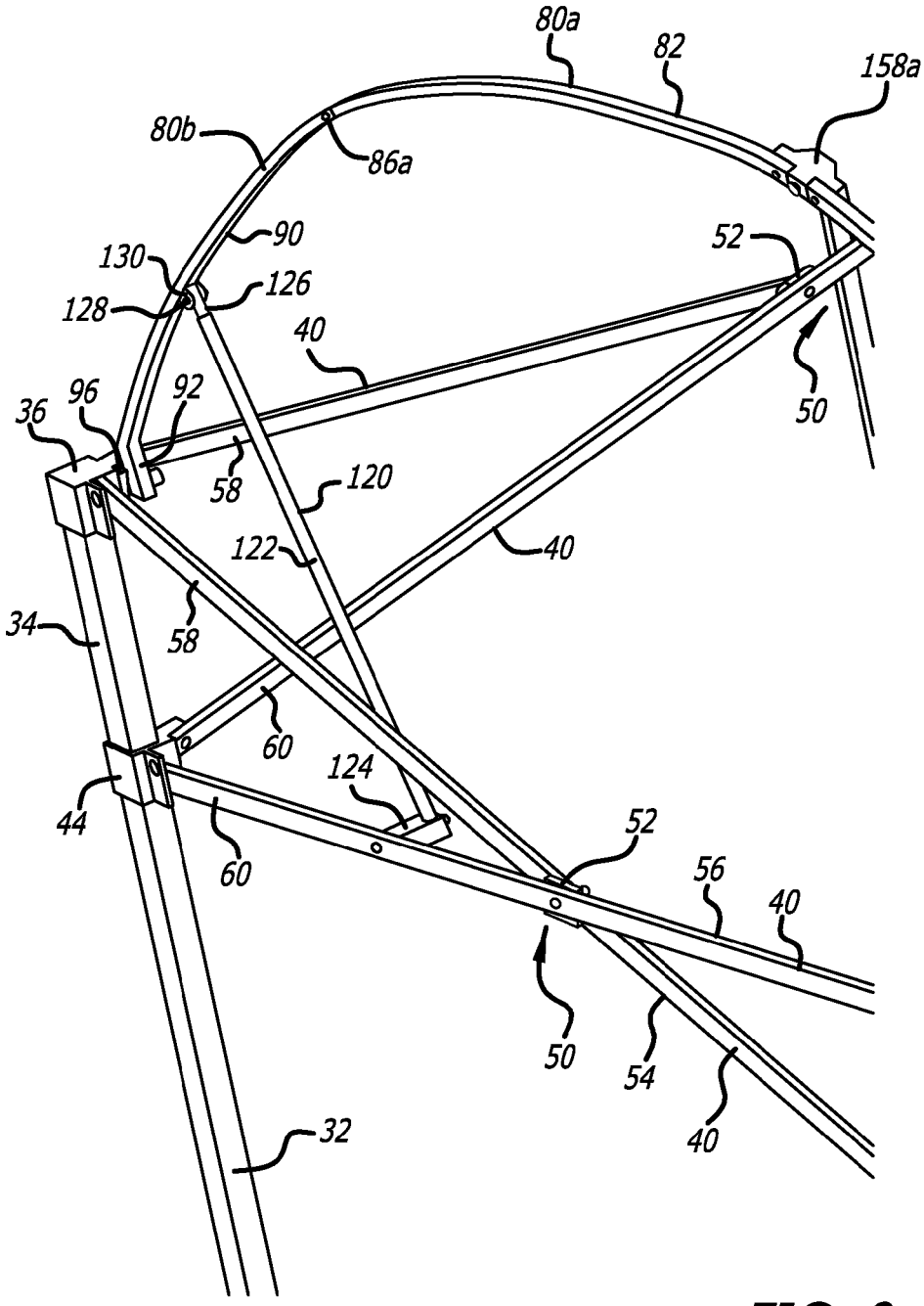
FIG. 9 is an enlarged perspective view of a portion of the quickly erectable dome shelter of FIG. 1, showing the peak truss rod assembly.
Figure 11:
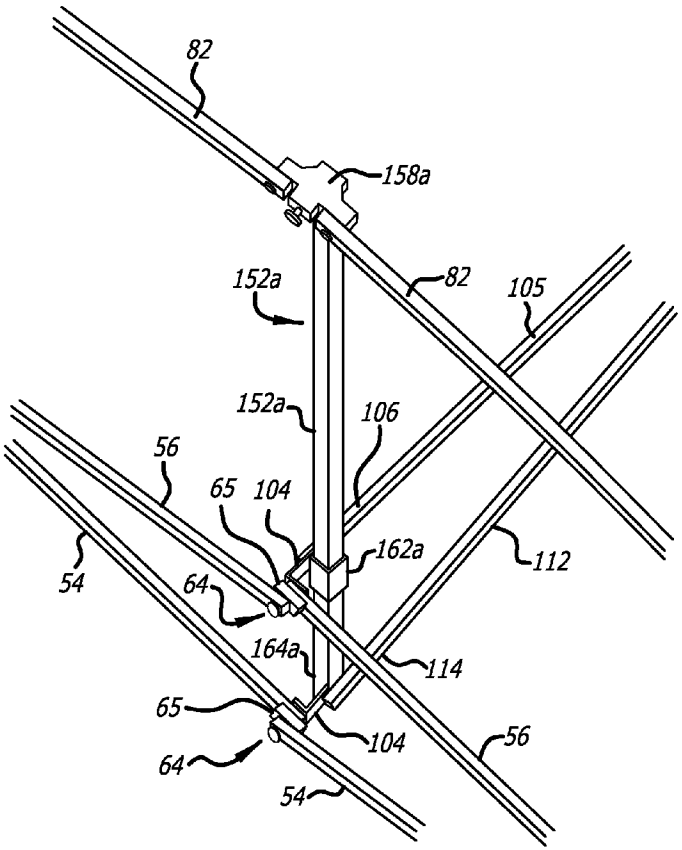
FIG. 11 is an enlarged perspective view of a portion of the quickly erectable dome shelter of FIG. 1, showing the mounting of a front side peak pole assembly.
Figure 12:
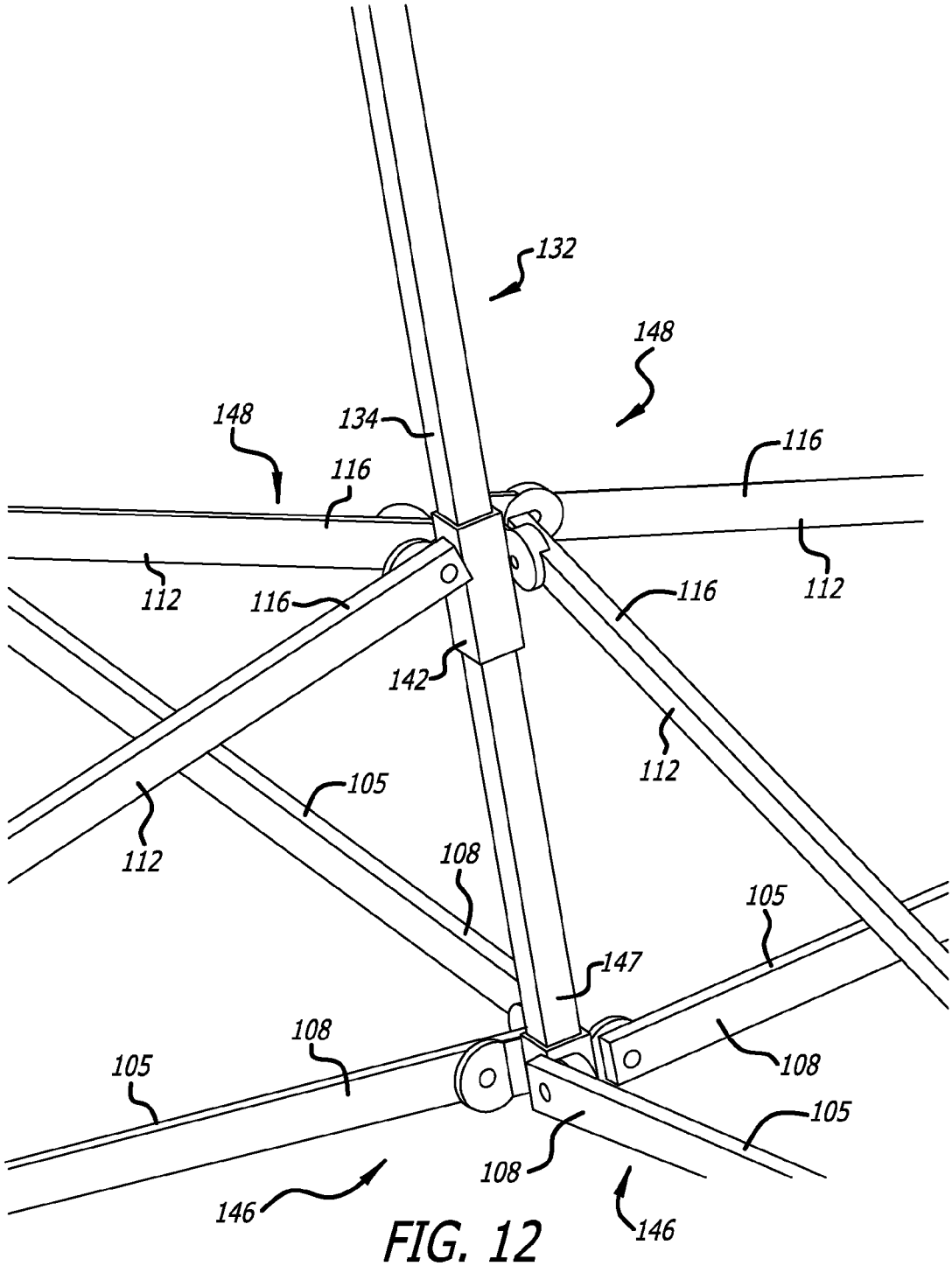
FIG. 12 is an enlarged perspective view of a portion of the quickly erectable dome shelter of FIG. 1, showing the mounting of the center peak pole to the central truss assembly of link members.

With reference to FIGS. 1 and 9, the link members of the extendible perimeter assembly connecting adjacent legs of the framework together typically includes X-shaped outer trusses 46 formed of pairs of the individual link members that are pivotally connected together at an outer truss pivot point 50, and typically spaced apart by a spacer member 52 at the outer truss pivot point. The pairs of link members include a first link member 54 and a second link member 56, the first link member having an inner end 57, and an outer end 58 pivotally connected to the upper end of a leg. The second link member having an outer end 60 pivotally connected to a slider member slidably mounted to the leg. The first and second link members are thus connected together in a scissors configuration so as to be extendable from a first collapsed position extending horizontally between pairs of legs to a second extended position extending horizontally between the pairs of legs, as is described in U.S. Pat. No. 5,490,533. On at least one the sides of the framework of the canopy shelter such an X-shaped outer truss and another adjacent X-shaped outer truss may be connected at their inner ends 64, and spaced apart by spacers 65, as shown in FIG. 11. The framework of the canopy shelter may also be formed to have a wide span on one or more sides by including one or more X-shaped middle trusses (not shown) not directly connected to the legs, and only supported by the outer trusses, as is described in U.S. Pat. No. 5,490,533.

Figure 7:
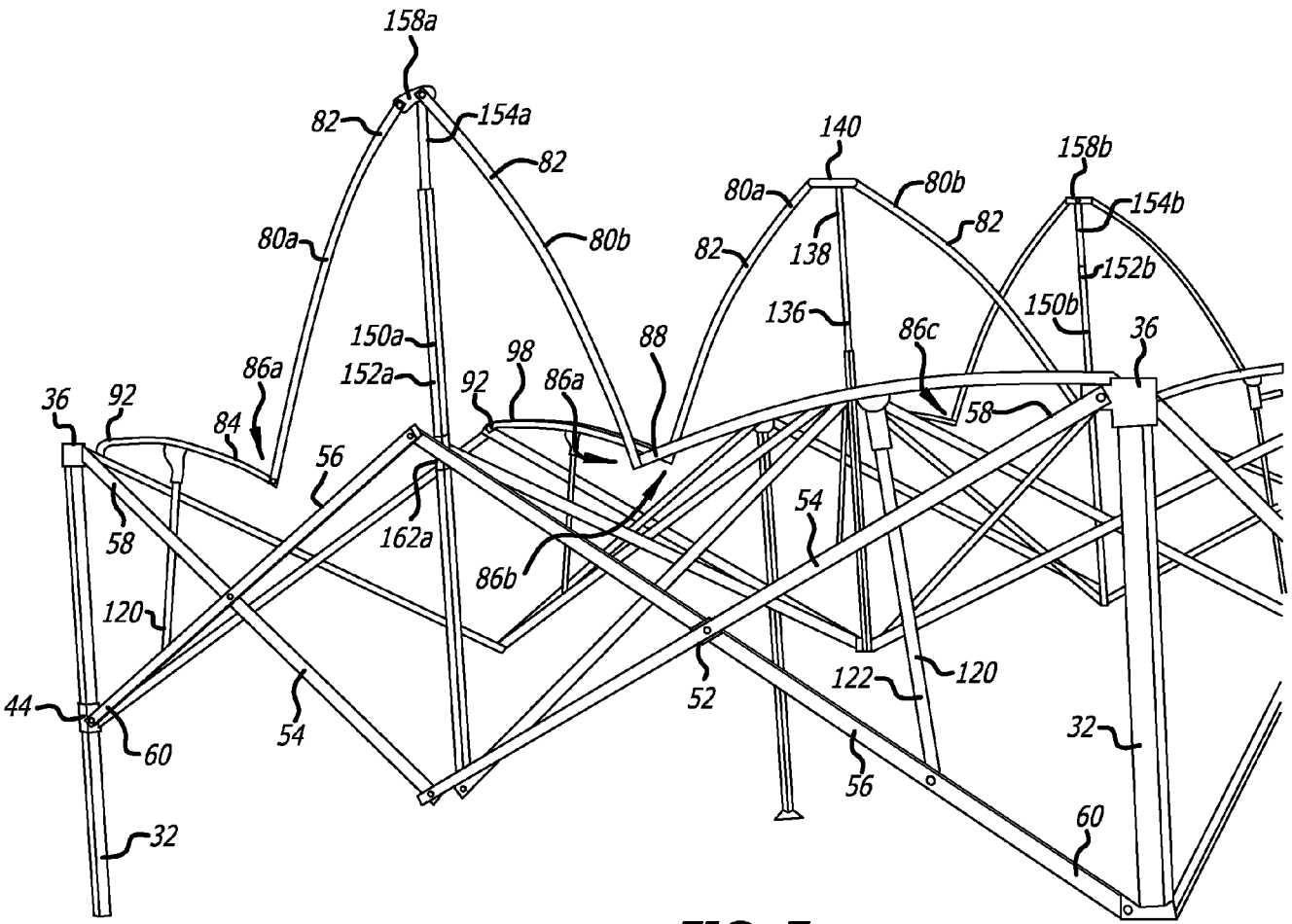
FIG. 7 is a perspective view of the quickly erectable dome shelter of FIG. 1, showing the roof structure in an intermediate collapsed, lowered configuration.
Figure 8:
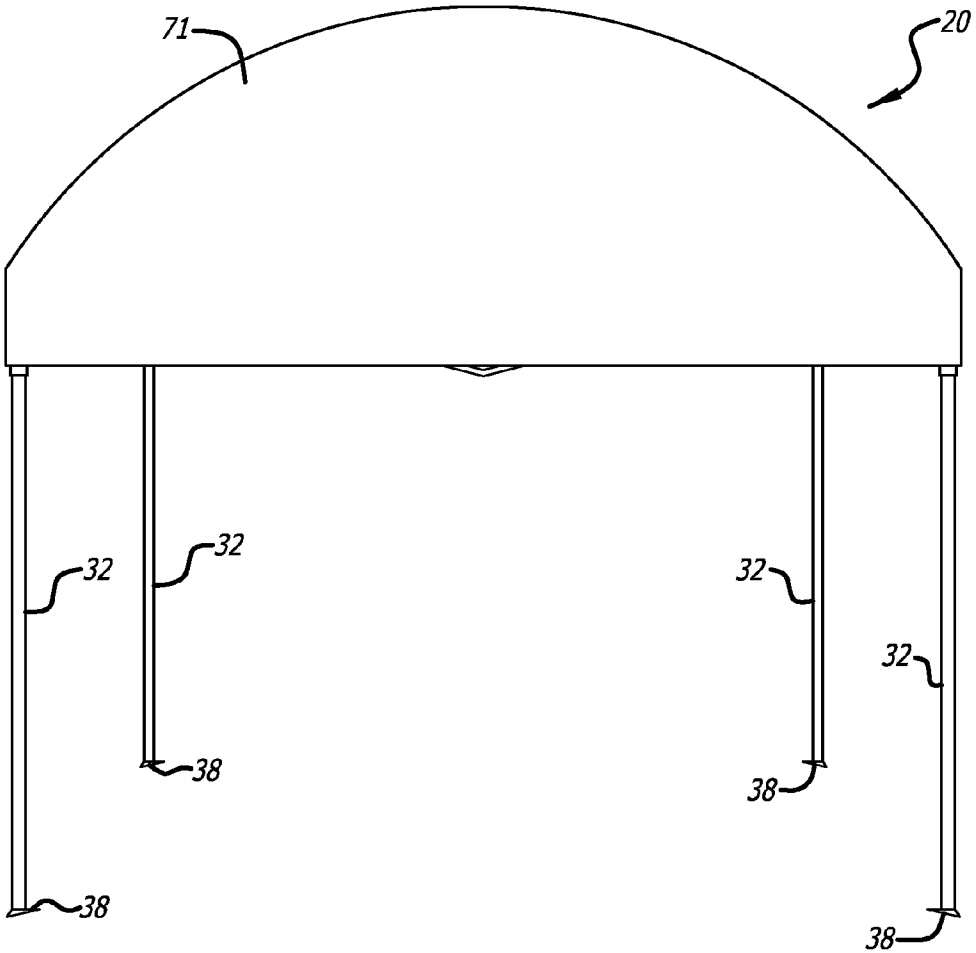
FIG. 8 is a front view of the quickly erectable dome shelter of FIG. 1 with a canopy cover.

Referring to FIGS. 1, 2 and 7, a roof framework 66 is pivotally mounted to the perimeter assembly and legs so as to extend across the shelter in an extended raised, upwardly arching configuration shown in FIGS. 1 and 2, and is movable between a lowered, collapsed configuration shown in FIG. 7 and the raised, upwardly arching position. As is illustrated in FIG. 8, a canopy cover 71 may be placed over the roof framework and secured to the tops of the legs, and is typically formed of nylon fabric, so as to be light and easily transportable, although the canopy cover may be made of other similar sheet materials, such as canvass, or other types of cloth fabric, or plastic. The roof framework includes a plurality of articulated peak truss assemblies 72*a,b,c*, with the central truss assembly of link members connected between opposing sides of the perimeter assembly to stabilize and support the quickly erectable dome shelter, and a plurality of peak pole members 78 pivotally and slidably coupled to the central truss assembly of link members and pivotally connected to the plurality of articulated peak truss assemblies at the upper ends of the peak pole members.

Figure 3:
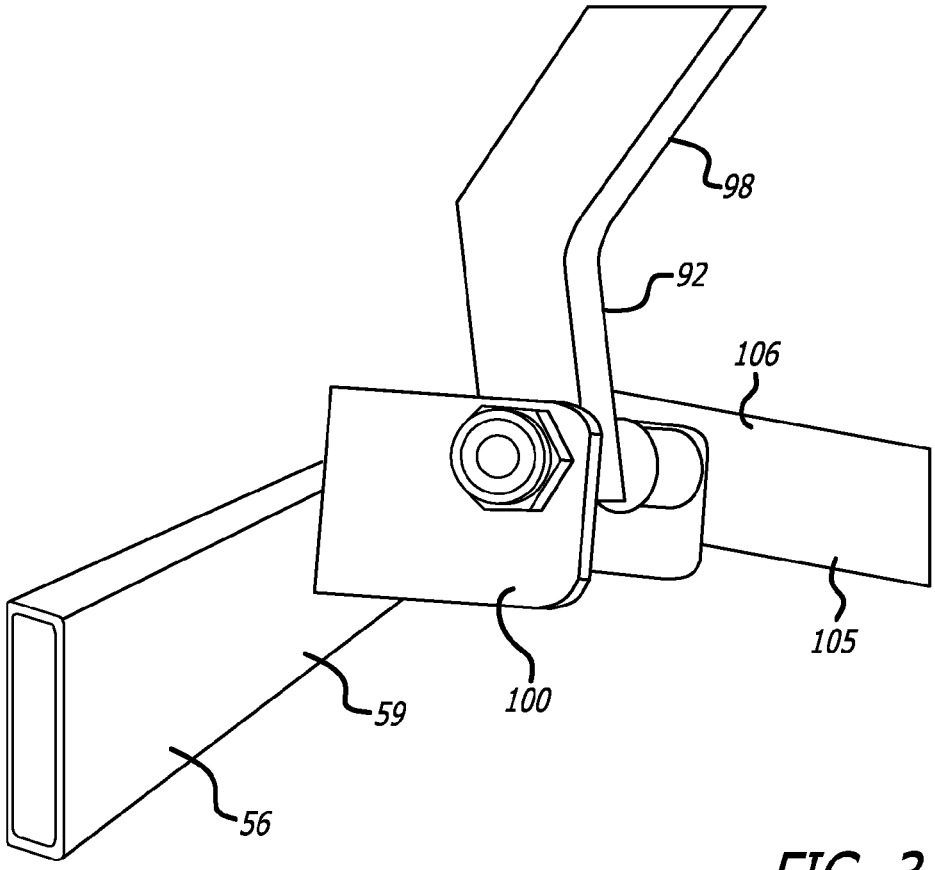
FIG. 3 is an enlarged perspective view of a connection of a bottom end or foot portion of a center lower peak truss member to the perimeter truss assembly and central truss assembly of link members of the quickly erectable dome shelter of FIG. 1.
Figure 4:
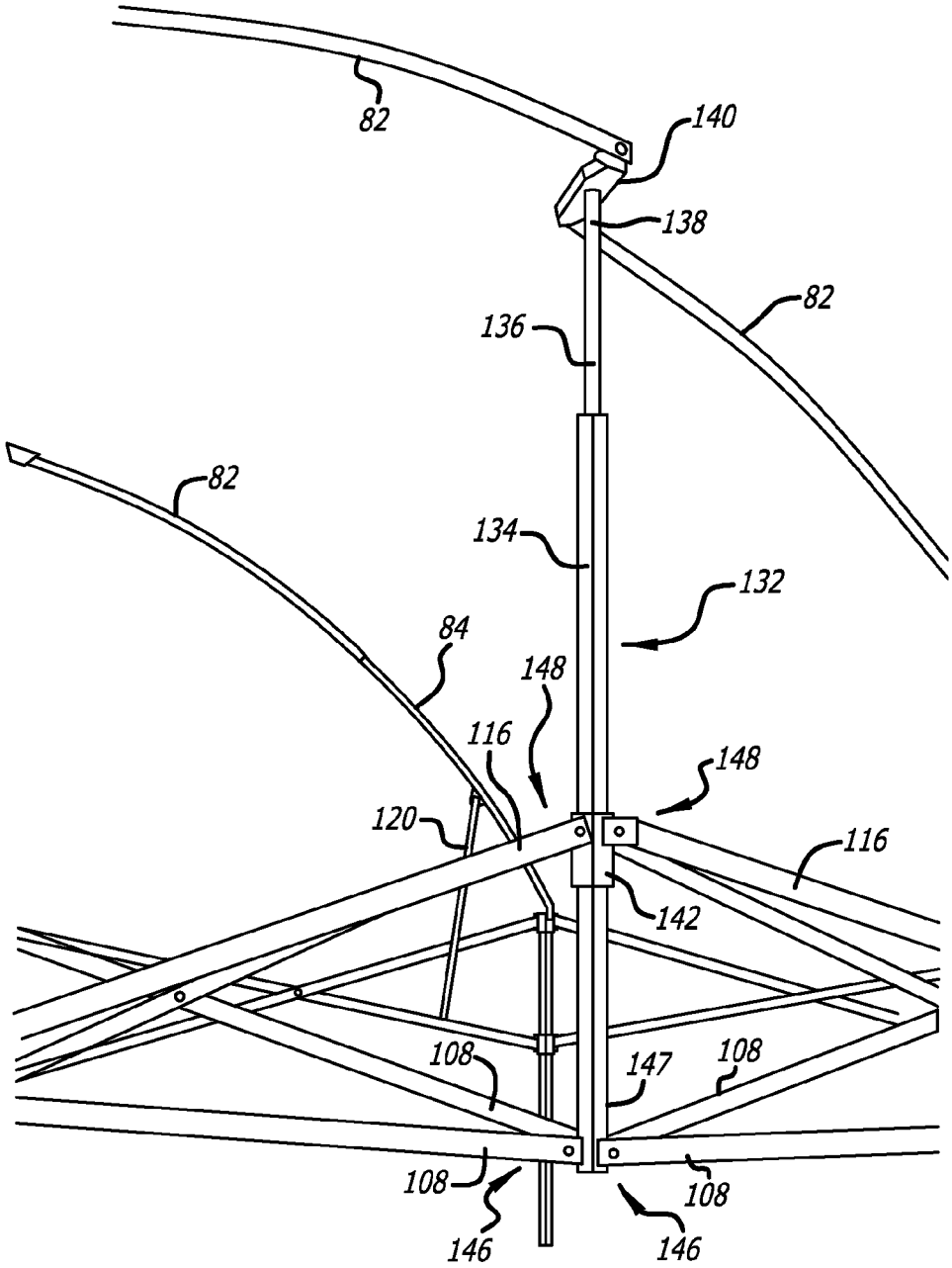
FIG. 4 is an enlarged view of the connection of the central telescoping peak pole member to the roof framework and the central truss assembly of link members of the quickly erectable dome shelter of FIG. 1.
Figure 10:
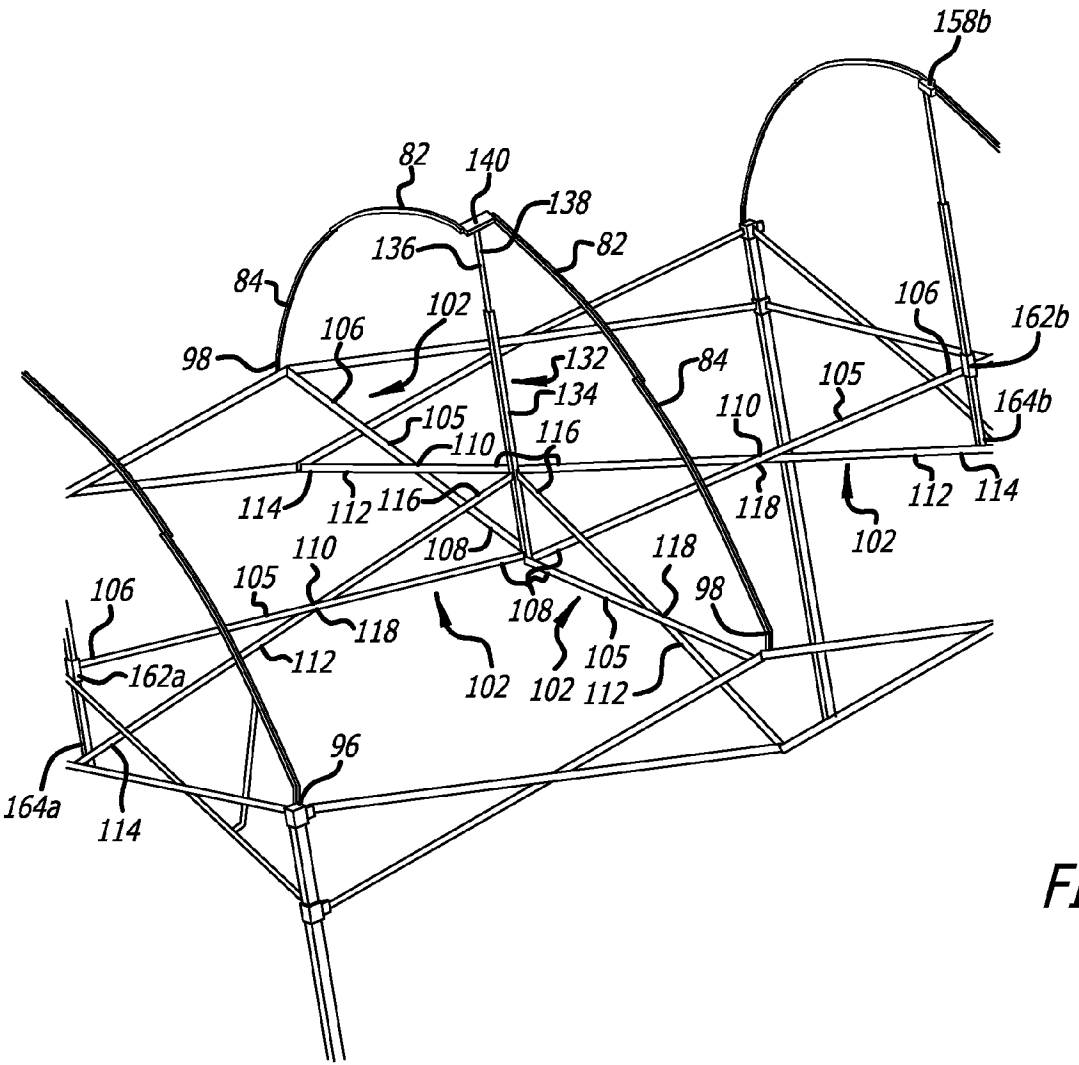
FIG. 10 is an enlarged perspective view of a portion of the quickly erectable dome shelter of FIG. 1, showing the central truss assembly of link members and center peak truss assembly of link members.

Referring to FIGS. 1, 7 and 9, each of the articulated peak truss assemblies includes first and second pairs 80*a,b* of curved upper peak truss members 82 and lower peak truss members 84 pivotally connected together at peak truss pivot points 86*a,b,c*, respectively, and typically spaced apart by a spacer member 88 at the peak truss pivot point. Each of the lower peak truss members includes an upper curved portion 90 and a bottom end or foot portion 92 that is typically straight and extending at an oblique angle from the upper curved portion. Referring to FIGS. 1, 9 and 10, the bottom ends or foot portions of the front and rear side lower peak truss members are pivotally connected by a peak mount bracket 96 to the perimeter assembly of link members and upper portion of a corresponding adjacent leg. The bottom ends or foot portions of the center lower peak truss members 98 are pivotally connected by a center peak mount bracket 100 to the perimeter assembly of link members and to the central truss assembly of link members as is illustrated in FIGS. 3 and 13.

Figure 13:
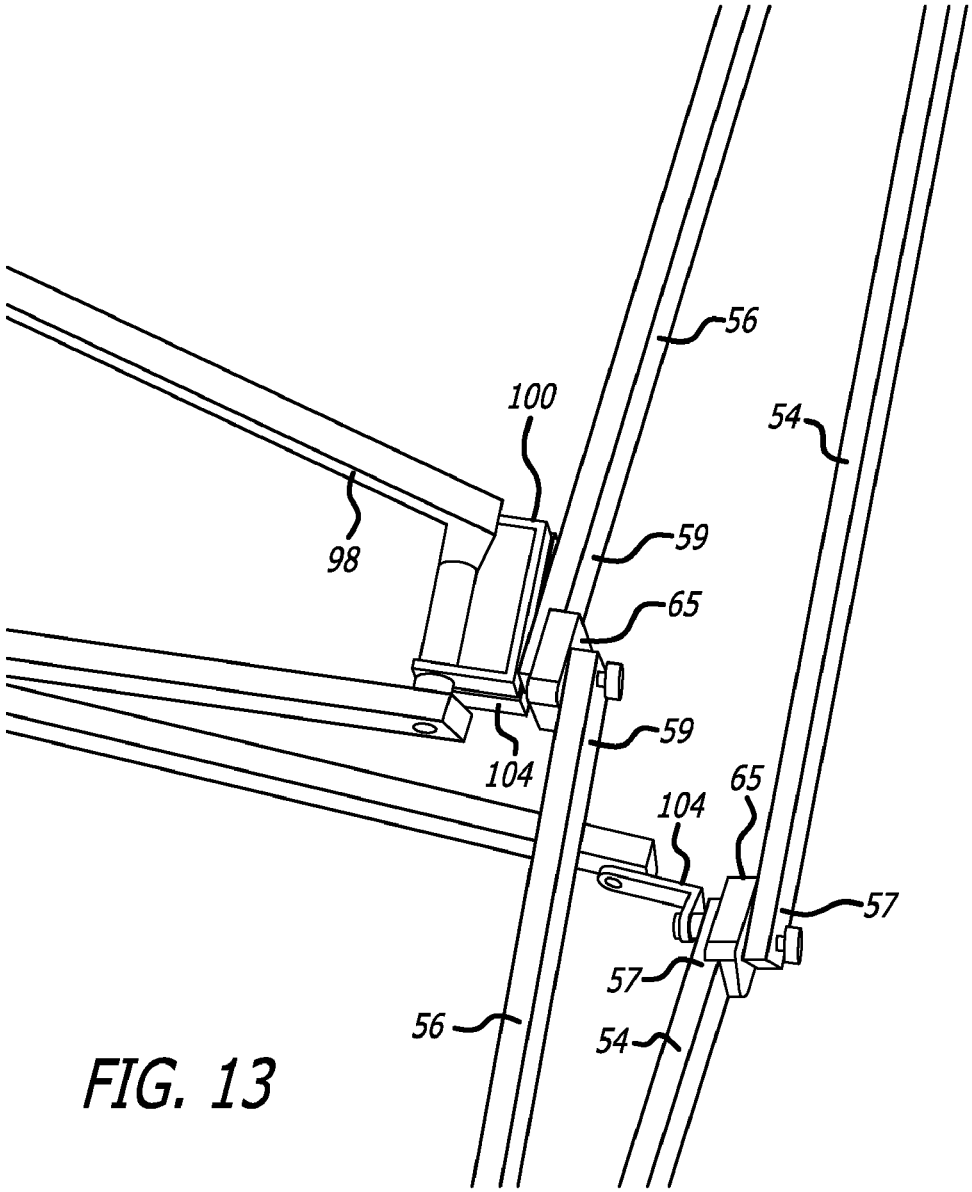
FIG. 13 is an enlarged perspective view of a portion of the quickly erectable dome shelter of FIG. 1, showing the mounting of a foot portion of a central lower peak truss member to the perimeter and central truss assemblies of link members.
Figure 14:
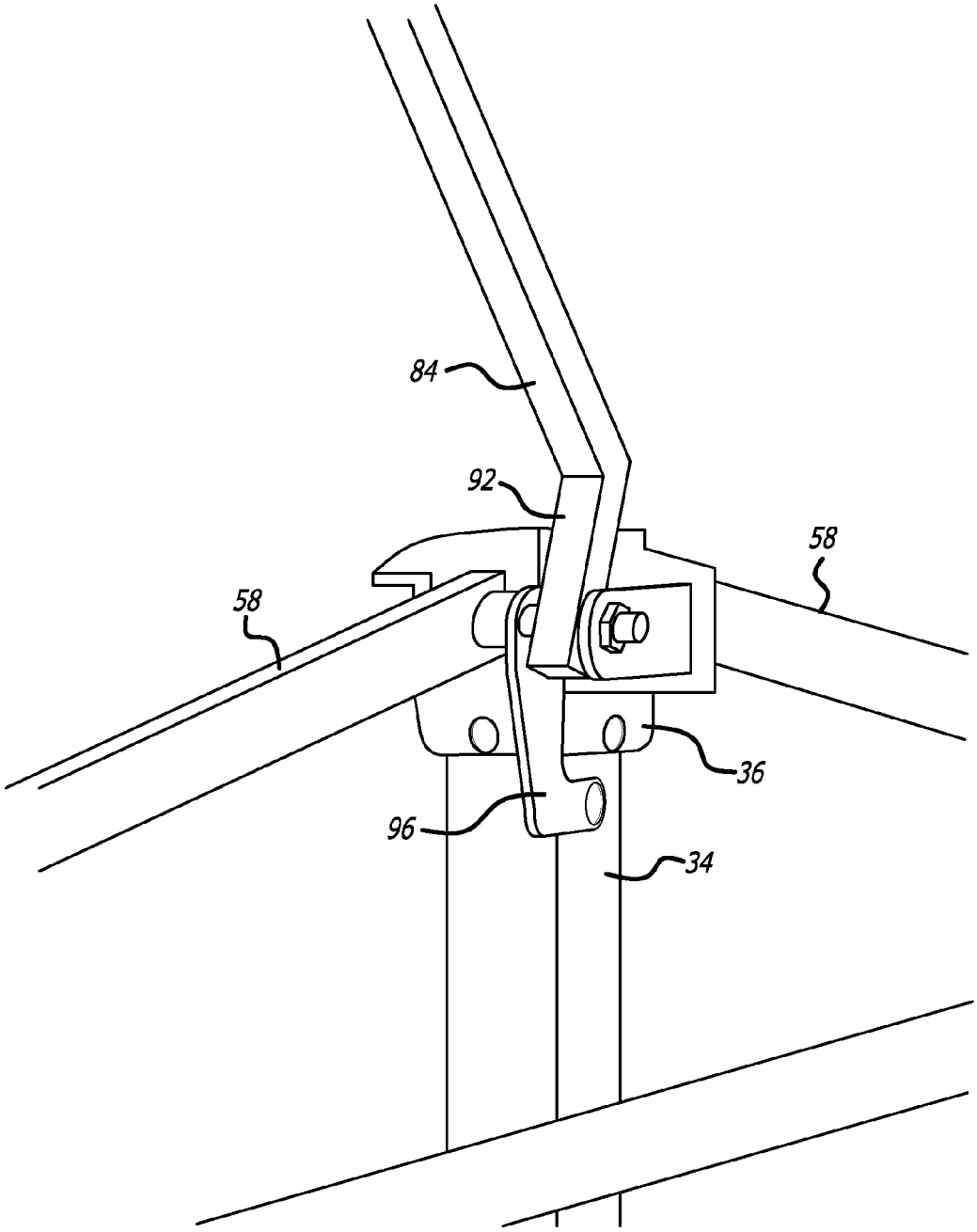
FIG. 14 is an enlarged perspective view of a portion of the quickly erectable dome shelter of FIG. 1, showing the mounting of a foot portion of a rear side lower peak truss member to the perimeter assembly of link members and a leg.

Referring to FIGS. 1, 11 and 13, the central truss assembly of link members includes a plurality of central truss pairs 102 of link members, with each of the central truss pairs being pivotally connected to the inner ends of the perimeter truss pairs at the outer truss pivot point, such as by right angle bracket members 104, to which the inner ends of the second perimeter truss pairs and the outer central truss pairs are pivotally connected. With reference to FIGS. 1 and 10, each of the central truss pairs preferably includes a first link 105 having an outer end 106 connected to the inner end of the second link of the perimeter truss pair, an inner end 108, and a central truss pivot point 110 located approximately at the longitudinal center point of the central truss pair first link. Each of the central truss pairs also preferably includes a second link 112 having an outer end 114 connected to the inner end of the first link of the perimeter truss pair, an inner end 116, and a central truss pivot point 118 located approximately at the longitudinal center point of the central truss pair second link. Each of the pivot points of the first and second links of the central truss pairs are pivotally connected together so that the central truss assembly of link members extends horizontally between the sides of the shelter framework.

Figure 5:
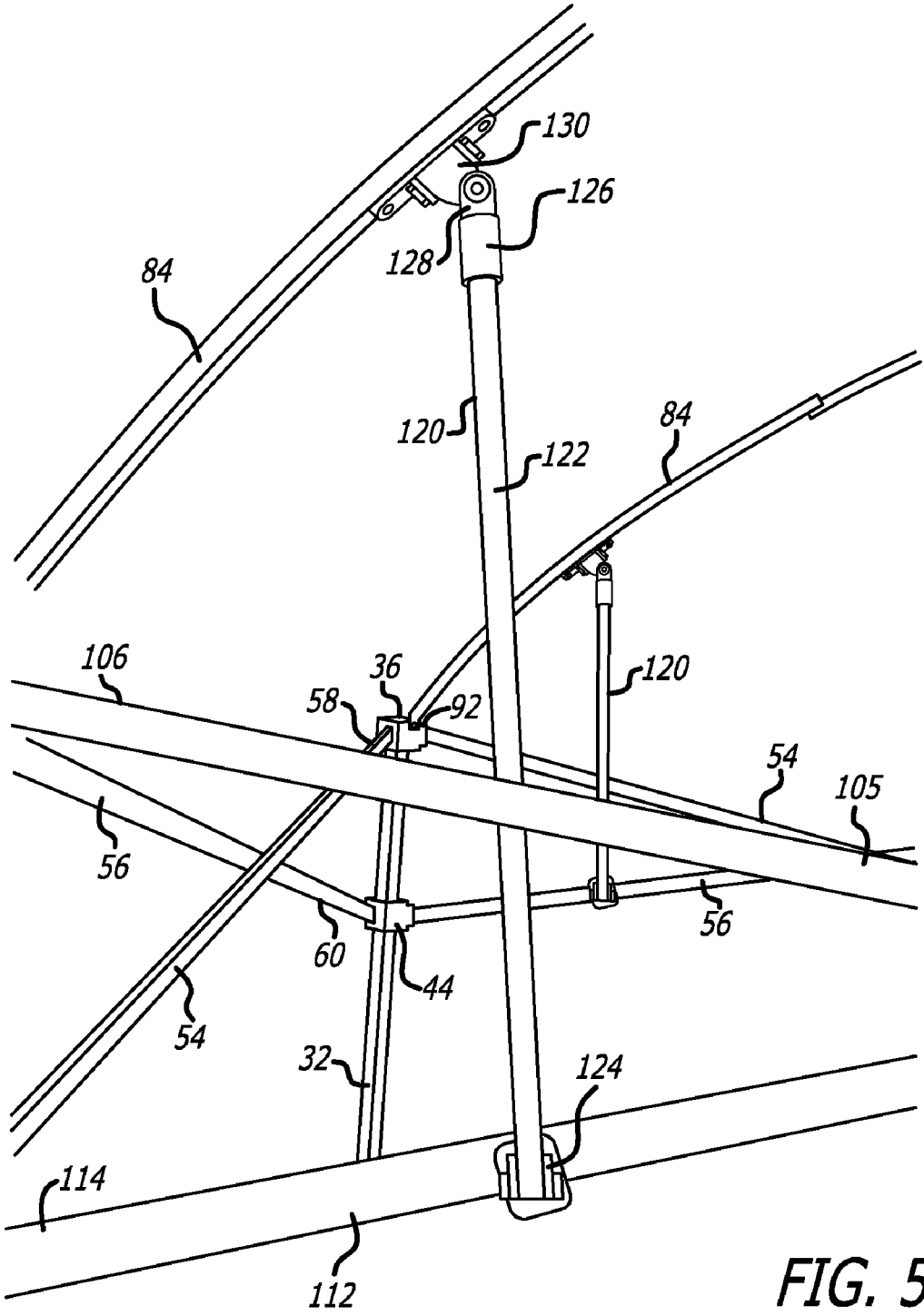
FIG. 5 is an enlarged view of the connection of a telescoping peak truss brace member between a peak truss member and a link member of the central truss assembly of link members of the quickly erectable dome shelter of FIG. 1.
Figure 6:
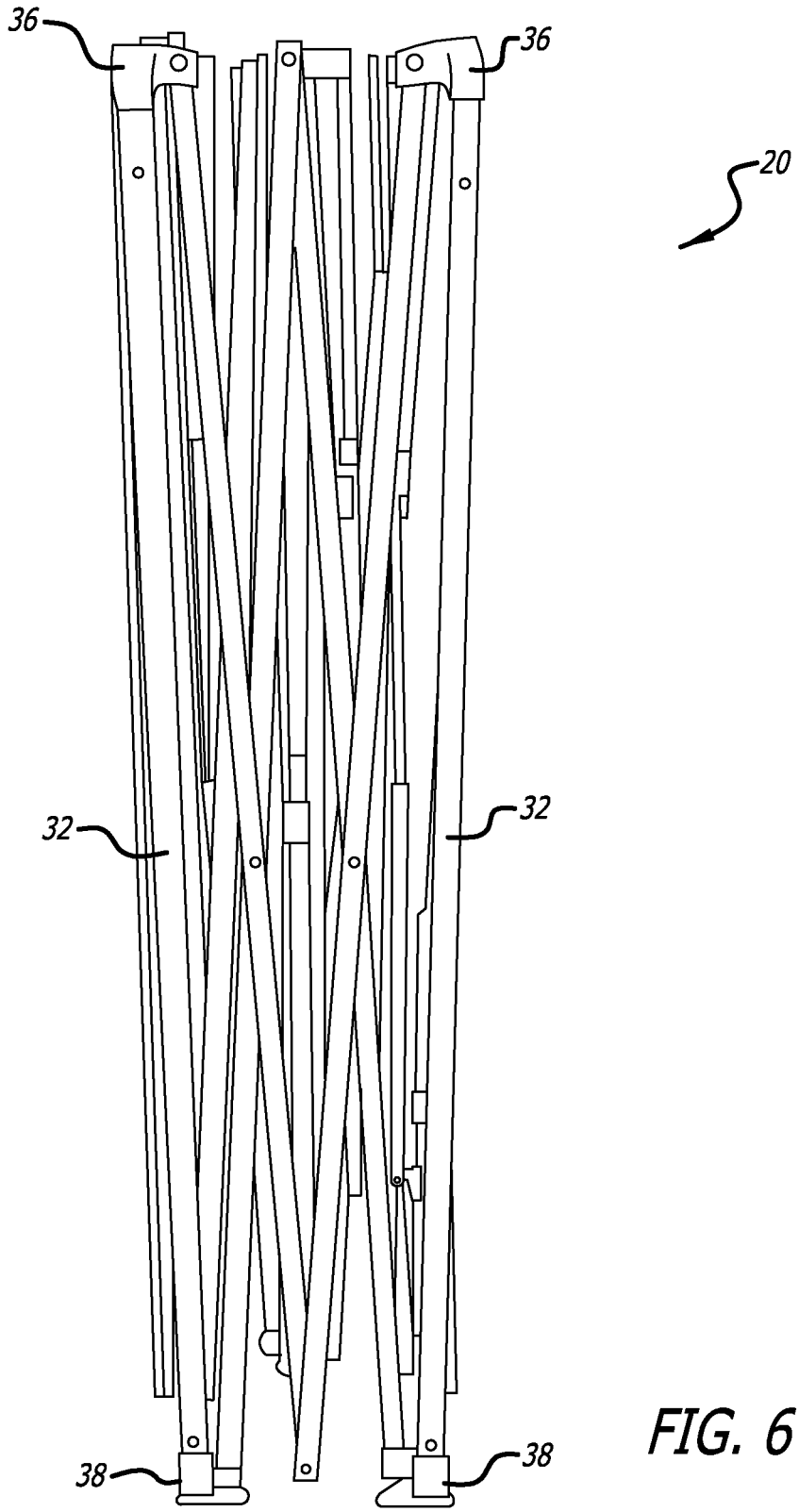
FIG. 6 is a front view of the quickly erectable dome shelter of FIG. 1 in a lowered, collapsed configuration.

As is illustrated in FIGS. 1, 2, 4, 5, 7 and 9, one or more of the curved peak truss members may be supported by a telescoping peak truss brace member 120 pivotally connected between a peak truss member and a link member of the perimeter assembly of link members or of the central truss assembly of link members. As is best seen in FIGS. 5 and 9, each telescoping peak truss brace member typically includes a hollow lower peak truss brace slider tube 122 pivotally connected to a link member of the perimeter assembly of link members or of the central truss assembly of link members by a peak truss rod slider spacer member 124 and an upper peak truss brace shaft 126 having a lower portion (not shown) slidably disposed within the hollow lower peak truss brace slider tube and including an upper end 128 with a yoke 130 pivotally connected to a lower peak truss member.

Referring to FIGS. 1, 4, 10 and 12, the inner ends of the central truss pairs are preferably connected to at least one vertically oriented central telescoping peak pole member 132 provided to support the canopy when the shelter framework is in an extended configuration. The central telescoping peak pole member typically includes a hollow lower peak pole slider tube 134 and an upper peak pole shaft 136 having a lower portion (not shown) slidably disposed within the hollow lower peak pole slider tube and including an upper end 138 with a central peak pole tip member 140 affixed at the top end of the upper peak pole shaft. A central peak pole slider member 142 is slidably mounted to the lower peak pole slider tube, and is pivotally connected to the upper inner ends of the central truss pairs. The lower inner ends 146 of each of the first links of the central truss pairs are preferably pivotally connected to the lower end 147 of the central peak pole member, and the upper inner ends 148 of each of the second links of the central truss pairs are preferably pivotally connected to the central slider member.

As is shown in FIGS. 1, 2, 7 and 11, the quickly erectable dome shelter may also include one or more vertically oriented front and rear side telescoping peak pole members 150*a*, 150*b*, provided to support the canopy when the shelter framework is in an extended configuration. Each of the one or more vertically oriented front and rear side telescoping peak pole members typically includes a hollow lower peak pole slider tube 152*a,b* and an upper peak pole shaft 154*a,b* having a lower portion (not shown) slidably disposed within the hollow lower peak pole slider tube. The front and rear upper peak pole shafts include an upper end 156*a,b* with a side peak pole tip member 158*a,b* affixed at the upper end of the upper peak pole shaft. As is best seen in FIGS. 7, 10 and 11, a side peak pole slider member 162*a,b* is slidably mounted to the lower peak pole slider tube, and is pivotally connected to the upper inner ends of the front and rear side perimeter truss pairs. The lower inner ends of each of the first links of the front and rear side perimeter truss pairs are preferably pivotally connected to the lower ends 164*a,b* of the side peak pole member, and the upper inner ends 168*a,b* of each of the second links of the front and rear side perimeter truss pairs are preferably pivotally connected to the side peak pole slider member.

It will be apparent from the foregoing that while particular forms of the invention have been illustrated and described, various modifications can be made without departing from the spirit and scope of the invention. Accordingly, it is not intended that the invention be limited, except as by the appended claims.

The invention claimed is:

1. A quickly erectable dome shelter having opposing front and rear sides and opposing lateral sides, comprising:

an extendible perimeter truss assembly having front, rear and opposing lateral sides, said extendible perimeter truss assembly including a plurality of legs and a plurality of perimeter truss pairs of link members connected between adjacent legs, each of said legs having an upper end and a lower end, and each of said perimeter truss pairs of link members including first and second link members having inner ends and outer ends;

a roof framework pivotally mounted to the extendible perimeter truss assembly so as to extend across the shelter in an extended raised, upwardly arching configuration, and said roof framework being movable between a lowered, collapsed configuration and the raised, upwardly arching position, said roof framework including a plurality of articulated peak truss assemblies each including a plurality of first and second pairs of curved upper peak truss members and curved lower peak truss members, wherein said plurality of articulated peak truss assemblies includes a center pair of first and second pairs of curved upper peak truss members and curved lower peak truss members, the center lower peak truss members having bottom end portions that are pivotally connected by a center peak mount bracket to the extendible perimeter truss assembly of link members, and said plurality of articulated peak truss assemblies including front side and rear side pairs of first and second pairs of curved upper peak truss members and curved lower peak truss members, the front and rear side lower peak truss members having bottom end portions that are pivotally connected by a peak mount bracket to the extendible perimeter truss assembly of link members and the upper portion of a corresponding adjacent leg; and a plurality of telescoping peak pole members having upper ends and lower ends, wherein said plurality of telescoping peak pole members are pivotally connected to corresponding ones of the plurality of articulated peak truss assemblies at the upper ends of the telescoping peak pole members.

2. The quickly erectable dome shelter of claim 1, wherein each of said plurality of legs comprises a slider member slidably mounted thereto.

3. The quickly erectable dome shelter of claim 2, wherein said plurality of perimeter truss pairs of link members of said extendible perimeter truss assembly comprises X-shaped outer trusses formed of pairs of said first and second link members pivotally connected together.

4. The quickly erectable dome shelter of claim 3, wherein each of said pairs of said first and second link members are pivotally connected together at a corresponding outer truss pivot point, and said pairs of said first and second link members are spaced apart by a spacer member at said corresponding outer truss pivot point.

5. The quickly erectable dome shelter of claim 4, wherein each of said first link members has an outer end pivotally connected to the upper end of a leg, and each of the second link members has an outer end pivotally connected to one said slider member.

6. The quickly erectable dome shelter of claim 1, wherein said plurality of telescoping peak pole members are pivotally connected to corresponding ones of the plurality of articulated peak truss assemblies at the upper ends of the telescoping peak pole members.

7. The quickly erectable dome shelter of claim 1, wherein said plurality of telescoping peak pole members comprises front side and rear side vertically oriented side telescoping peak pole members.

8. The quickly erectable dome shelter of claim 1, said plurality of telescoping peak pole members comprises at least one vertically oriented central telescoping peak pole member.

9. The quickly erectable dome shelter of claim 8, wherein said central telescoping peak pole member comprises a hollow lower peak pole slider tube and an upper peak pole shaft slidably disposed within the hollow lower peak pole slider tube, said upper peak pole shaft including an upper end with a central peak pole tip member affixed at the top end of the upper peak pole shaft.

* * * * *